US008047183B2

(12) United States Patent
Aronhalt et al.

(10) Patent No.: US 8,047,183 B2
(45) Date of Patent: Nov. 1, 2011

(54) FUEL INJECTOR, CLAMPING ASSEMBLY AND METHOD OF MOUNTING A FUEL INJECTOR

(75) Inventors: Daniel E. Aronhalt, Elizabethtown, IN (US); Mark N. Bays, Columbus, IN (US); Jason T. Czapka, Greenwood, IN (US)

(73) Assignee: Cummins Intellectual Properties, Inc., Minneapolis, MN (US)

( * ) Notice: Subject to any disclaimer, the term of this patent is extended or adjusted under 35 U.S.C. 154(b) by 335 days.

(21) Appl. No.: 12/474,723

(22) Filed: May 29, 2009

(65) Prior Publication Data

US 2010/0300408 A1 Dec. 2, 2010

(51) Int. Cl.
*F02M 61/14* (2006.01)

(52) U.S. Cl. ..... 123/470

(58) Field of Classification Search ..... 123/470
See application file for complete search history.

(56) References Cited

U.S. PATENT DOCUMENTS

| | | | | |
|---|---|---|---|---|
| 3,343,798 | A | 9/1967 | Senft | |
| 4,246,877 | A | 1/1981 | Kennedy | |
| 5,566,658 | A * | 10/1996 | Edwards et al. | 123/470 |
| 5,697,345 | A * | 12/1997 | Genter et al. | 123/470 |
| 6,116,218 | A * | 9/2000 | Sato et al. | 123/470 |
| 6,286,768 | B1 | 9/2001 | Vetters et al. | |
| 6,431,152 | B1 | 8/2002 | Estacio | |
| 6,655,356 | B2 * | 12/2003 | Lippert | 123/470 |
| 6,684,860 | B2 * | 2/2004 | Baessler et al. | 123/470 |
| 6,718,949 | B2 * | 4/2004 | Gmelin | 123/470 |
| 6,745,752 | B1 * | 6/2004 | Jensen et al. | 123/470 |
| 6,769,409 | B2 | 8/2004 | Evancik et al. | |
| 6,840,227 | B2 * | 1/2005 | Reiter et al. | 123/470 |
| 6,895,939 | B2 | 5/2005 | Gould et al. | |
| 7,461,638 | B2 * | 12/2008 | Scheffel et al. | 123/470 |
| 7,886,717 | B2 * | 2/2011 | Rettig et al. | 123/470 |

(Continued)

FOREIGN PATENT DOCUMENTS

JP H06-001771 U 1/1994

(Continued)

OTHER PUBLICATIONS

Notification of transmittal of the International Search Report and the Written Opinion of the International Searching Authority, or the Declaration with mailing date of Jan. 20, 2011; International Application No. PCT/US2010/036518.

US 6,027,046, 02/2000, Vetters et al. (withdrawn)

*Primary Examiner* — Thomas Moulis

(74) *Attorney, Agent, or Firm* — Studebaker & Brackett PC; Tim L. Brackett, Jr.

(57) ABSTRACT

A fuel injector, a method of mounting a fuel injector, a combination injector and clamping, and a clamp are all provided for ensuring the fuel injector is mounted in a proper rotative position in an injector mounting bore of any one of multiple internal combustion engine platforms requiring different injector mounting positions. The injector includes a first alignment feature having a first geometry corresponding to a first engagement feature of the first engine platform and adapted to be engaged by the first engagement feature to secure the injector to the first engine platform. The fuel injector further includes a second alignment feature having a second geometry different from, and incompatible with, the first geometry and corresponding to a second engagement feature of the second engine platform thereby ensuring the fuel injector is circumferentially oriented in a correct rotative position required by a given engine platform.

22 Claims, 6 Drawing Sheets

U.S. PATENT DOCUMENTS

| | | | | |
|---|---|---|---|---|
| 2002/0152995 | A1* | 10/2002 | Kato | 123/470 |
| 2002/0162538 | A1* | 11/2002 | Krause et al. | 123/470 |
| 2004/0011334 | A1 | 1/2004 | Pohlmann et al. | |
| 2005/0016501 | A1* | 1/2005 | Krause et al. | 123/470 |
| 2009/0314258 | A1* | 12/2009 | Azou | 123/470 |

FOREIGN PATENT DOCUMENTS

| | | | |
|---|---|---|---|
| JP | 2004-090024 | A | 3/2004 |
| JP | 2005-307775 | A | 11/2005 |
| JP | 2006-207561 | A | 8/2006 |

* cited by examiner

FUEL INJECTOR, CLAMPING ASSEMBLY AND METHOD OF MOUNTING A FUEL INJECTOR

TECHNICAL FIELD

The present invention generally relates to internal combustion engine fuel injection systems. More particularly, the present invention relates to a fuel injector and a fuel injector hold-down clamping system for circumferentially orienting, and securing, the fuel injector within the fuel injector mounting bore of the engine's cylinder head.

BACKGROUND

In many diesel engine platforms, or configurations, it is desirable, or necessary, to specifically orient a given cylinder's fuel injector to accommodate the positioning of the fuel line inlet connection, to position the injector's fuel spray orifices to obtain a desired fuel disbursement pattern within the cylinder, or to properly position an electrical connection.

It is known in the industry to employ mechanical means to obtain such fuel injector orientation such as taught in U.S. Pat. No. 3,343,798, issued to Karl Senfit, wherein mating indexes are used to properly position the fuel injector within the cylinder.

In an engine manufacturing facility producing engines having various engine configurations, or platforms, it is common to use a given fuel injector type for all engines. However, because of the differing engine platforms often having different fuel injector packaging requirements, such as the location of the fuel supply plumbing relative to the fuel injector, it is necessary to correctly position the fuel injector in accord with the particular engine's platform. For example, the fuel injector's fuel inlet may require a differing injector orientation for each of the various engine platforms being manufactured. With the teachings of Senfit, a distinct injector configuration, and respective part number, would be necessary for each engine platform and possibly for each individual cylinder of a given cylinder head resulting in numerous injector configurations and part numbers.

SUMMARY OF THE INVENTION

The various advantages of the present invention may be achieved by providing, in a fuel injected internal combustion engine, a method of mounting a fuel injector in a proper rotative orientation in an injector mounting bore of any one of multiple internal combustion engine platforms capable of receiving the fuel injector where the engine platforms require differing fuel injector orientations. The method comprises providing a fuel injector having a first alignment feature with a first geometry corresponding to a first engagement feature of a first engine platform and a second alignment feature having a second geometry different from the first geometry and corresponding to a second engagement feature of a second engine platform. The method also includes inserting the fuel injector into the mounting bore of the first engine platform; providing a fuel injector hold down clamp attached to the internal combustion engine and including the first engagement feature which is compatible with the first alignment feature; and positioning the fuel injector with the first alignment feature in alignment with the first engagement feature and engaging the first alignment feature with the first engagement feature thereby rotatively orientating the fuel injector for the first engine platform.

The present invention is also directed to a fuel injector mountable in a mounting bore of a first engine platform and a mounting bore of a second engine platform of fuel injected internal combustion engines, comprising a fuel injector body including a first alignment feature having a first geometry corresponding to a first engagement feature of the first engine platform and adapted to be engaged by the first engagement feature to secure the injector to the first engine platform. The fuel injector further includes a second alignment feature having a second geometry different from the first geometry and corresponding to a second engagement feature of the second engine platform, wherein the second alignment feature is adapted to be engaged by the second engagement feature to secure the injector to the second engine platform.

The present invention is also directed to the combination of a fuel injector mountable in a mounting bore of a first engine platform and a mounting bore of a second engine platform of fuel injected internal combustion engines, and a fuel injector hold down clamp, comprising the fuel injector hold down clamp adapted to secure the fuel injector in the mounting bore of a internal combustion engine wherein the clamp includes a first engagement feature. This invention also includes the fuel injector including a first alignment feature having a first geometry corresponding to the first engagement feature of the first engine platform and adapted to be engaged by the first engagement feature to secure the injector in the mounting bore of the first engine platform. The fuel injector further includes a second alignment feature having a second geometry different from the first geometry and corresponding to a second engagement feature of the second engine platform. The second alignment feature is adapted to be engaged by the second engagement feature to secure the injector on the second engine platform.

The present invention is also directed to a fuel injector hold down clamp for use on a fuel injected internal combustion engine comprising a main body, a device for attaching the main body to the engine, and a lever arm extending outward from the main body. The lever arm includes at least one prong for straddling a fuel injector and at least two convex bosses extending from said at least one prong to engage two associated concave notches upon a fuel injector.

In one or more of the inventions described above, the first alignment feature may be incompatible with the second engagement feature, and the second alignment feature may incompatible with the first engagement feature. Also, the first alignment feature may include a pair of notches and the first engagement feature may include a pair of bosses adapted to engage the pair of notches. Alternatively, or additionally, the second alignment feature may be a single notch and the second engagement feature may be a single boss. The first alignment feature may include a depth and the second alignment feature may include a depth greater than the depth of the first alignment feature. In addition, or alternatively, the first alignment feature may include a width greater than a width of the second alignment feature. The injector may include at least one alignment feature in addition to the first and the second alignment feature, and these combinations of features may be any combination of the disclosed features and equivalents thereof.

BRIEF DESCRIPTION OF THE DRAWINGS

FIGS. 5 and 6 present additional top views similar to that of FIG. 3 illustrating alternate embodiments of the present invention.

DETAILED DESCRIPTION OF THE INVENTION

Figure 1:
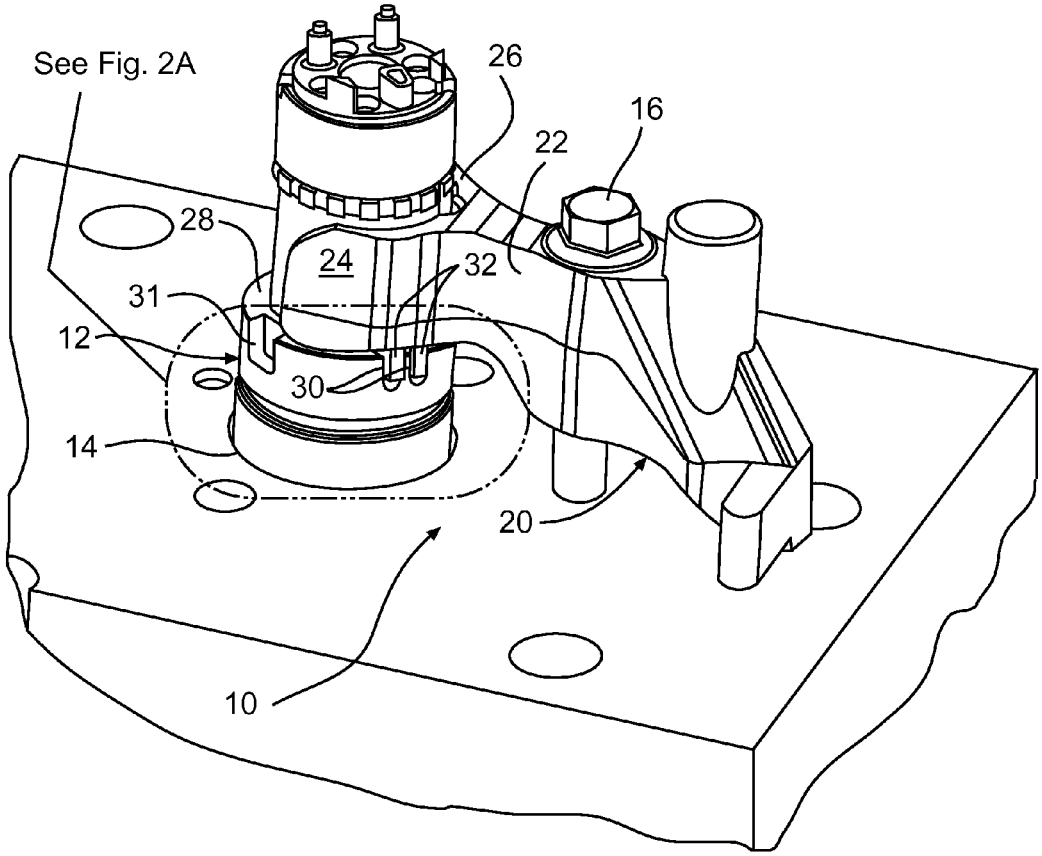
FIG. 1 presents a partial pictorial view of a diesel engine head assembly embodying our invention.
Figure 2A:
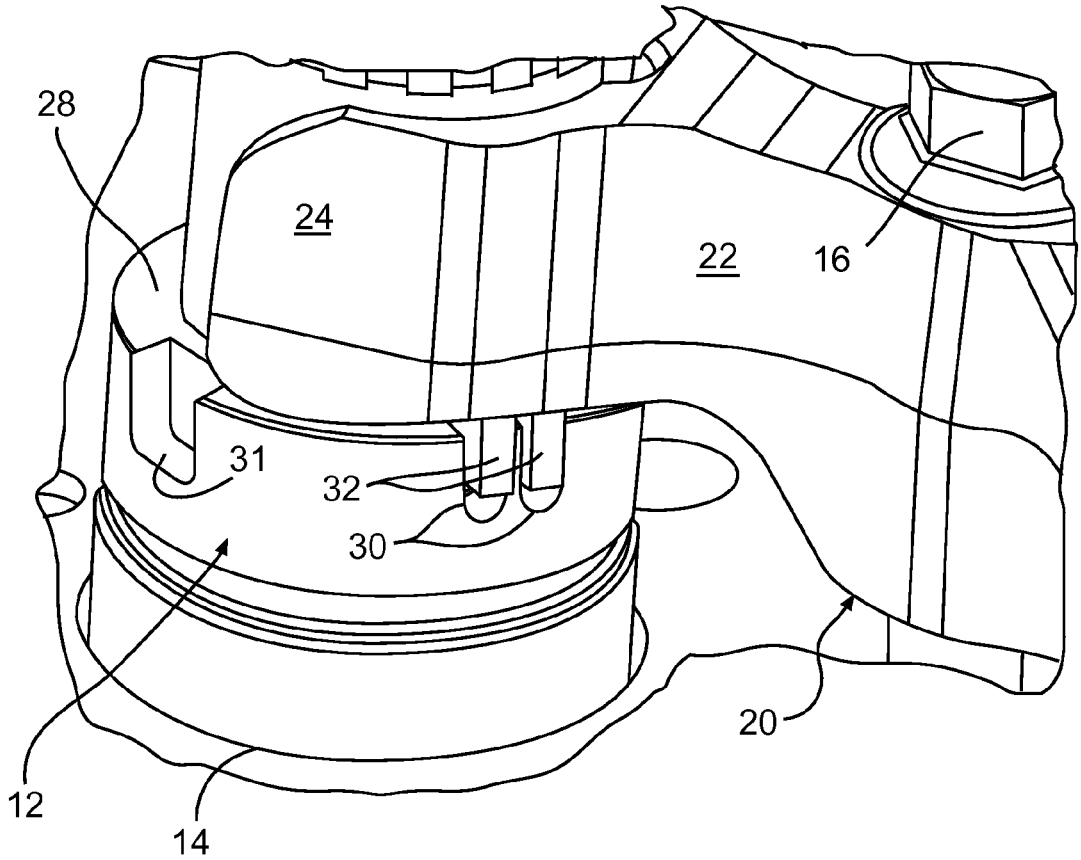
FIG. 2A presents a close-up pictorial view of the circled area in FIG. 1.
Figure 3:
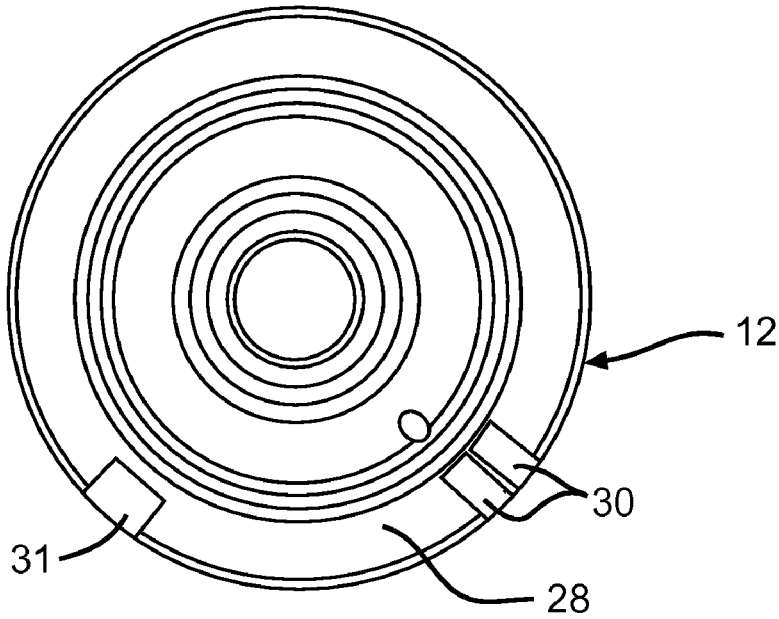
FIG. 3 presents a top view of the fuel injector shown in FIG. 2.

Referring to FIGS. 1, 2A, and 3, an engine cylinder head 10, of a fuel injected, internal combustion engine such as a diesel engine, is illustrated having a fuel injector 12 inserted into a fuel injector mounting bore 14 corresponding to a first type of engine platform. Fuel injector 12 is held in place by fuel injector retaining clamp assembly 20. Fuel injector clamp assembly 20 is affixed to cylinder head 10 by any convenient means known within the art, such as bolt 16.

Clamp assembly 20 includes a main body and a cantilever arm 22 extending from the main body to contact, and apply a mounting force to, the injector. In the exemplary embodiment, cantilever arm 22 is a fork-style clamp terminating in a first prong 24 and a second prong 26. Prongs 24 and 26 may extend generally parallel to one another and may extend around approximately 180 degrees of the fuel injector's periphery as illustrated in FIG. 1 thereby positioning the fuel injector 12 within the fuel injector mounting bore 14. Fuel injector 12 includes a radially extending, peripheral shoulder 28. Alternatively, clamp assembly 20 may be any shape and style capable of incorporating at least one of the engagement features of the present invention for engaging at least one of the alignment features of the present invention as discussed below. For example, a clamp assembly may extend completely around and/or completely over the injector.

In the exemplary embodiment of the Figs., when assembled, prongs 24 and 26, extending astride the fuel injector, rest upon peripheral shoulder 28 and apply a downwardly applied force to shoulder 28 thereby securely clamping fuel injector 12, in place, within fuel injector bore 14. The injector of the present invention includes an injector body having a first alignment feature having a first geometry for mating engagement by a first engagement feature of a clamp assembly 20 associated with the first type of engine platform, and a second alignment feature having a second geometry, different than the first geometry of the first alignment feature, for mating engagement by a second engagement feature of a clamp assembly associated with a second type of engine platform different from the first type. In an exemplary embodiment, a first alignment feature may include a pair of notches, or slots, 30 formed in peripheral shoulder 28 and preferably positioned at the peripheral edge of shoulder 28 as illustrated in FIGS. 1, 2A, and 3. The first engagement feature of this embodiment may include a pair of engagement bosses 32 extending downward from forked prong 24 for engaging slots 30 thereby aligning fuel injector 12 in a predetermined orientation within fuel injector bore 14 as required by the particular engine platform, i.e., the first type of engine platform. The first engagement feature may alternatively extend from second prong 26 or from the portion of the clamp between the prongs.

Figure 2B:
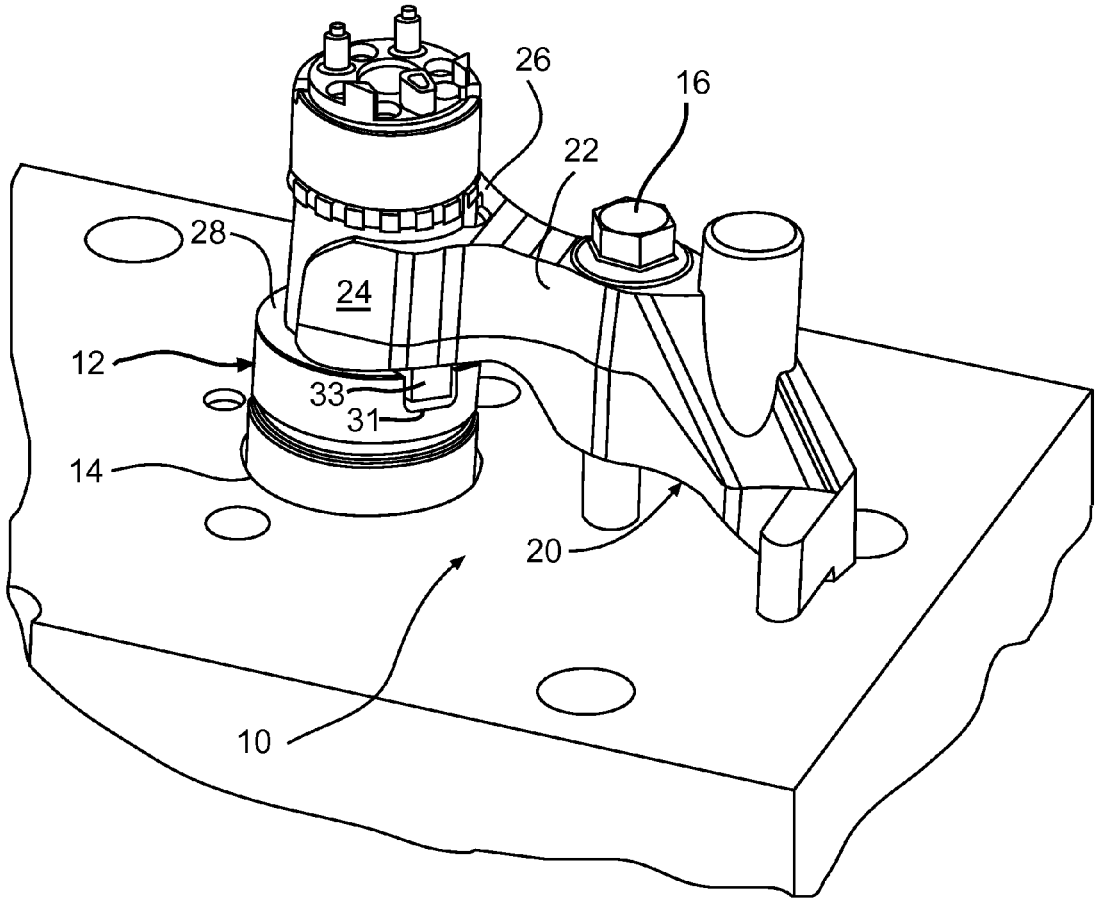
FIG. 2B presents a close-up pictorial view similar to FIG. 2A illustrating the head assembly of a second engine platform with the same injector of FIG. 1.

FIG. 2B shows the second type of engine platform which is different from the first type of engine platform in that the injector must be oriented in a different rotative position to properly align certain features of the injector with features of the engine, such as fuel passages in the injector with passages in the bore, the injector spray orifices with the combustion chamber/piston arrangement, an electrical connection, and/or any other alignment requirement. The second alignment feature of the exemplary embodiment of the injector of the present invention may include a notch 31 formed in shoulder 28. The second engagement feature associated with the second type of engine platform may include a single boss 33 having a geometry configured to be complementary to the geometry of notch 31 such that boss 33 closely mates with notch 31 to ensure the fuel injector is positioned in a predetermined aligned rotative position in the mounting bore. Notch 31 has a uniquely different geometry than that of one and both of slots 30 such that the first engagement feature, i.e. engagement bosses 32, are incompatible with, and thus will not mate with, the second alignment feature, i.e. notch 31. Likewise, the second engagement feature, i.e. boss 33, will not mate with the first alignment feature, i.e. slots 30.

Figure 4A:
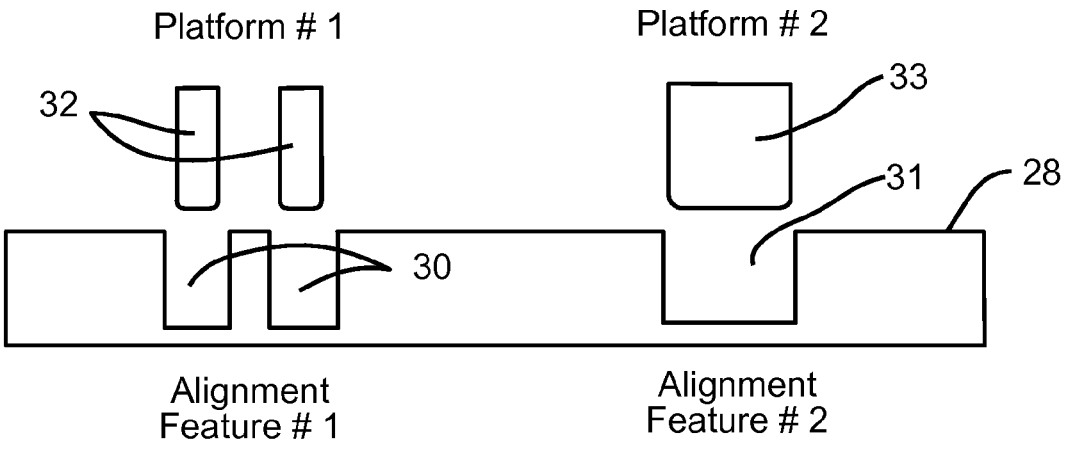
FIGS. 4A and 4B present graphical representations of the alignment features of the present invention.
Figure 4B:
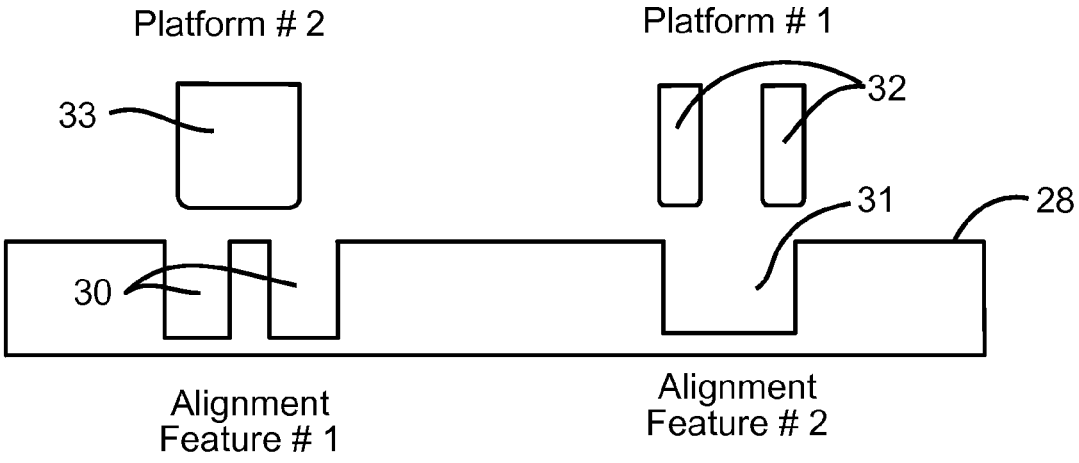

Thus as illustrated in FIGS. 4A and 4B, the first alignment feature 1 and the second alignment feature 2 are mutually exclusive of one another in that they cannot be engaged by the same single engagement feature of a particular engine platform. Engagement boss 32 will be physically compatible with, and thus engage, alignment slot 30 (alignment feature 1) but will be physically incompatible with, and thus not engage, alignment slot 31 because of physical or geometrical interference Likewise engagement boss 33 will engage alignment slot 31, but will not engage alignment slots 30 because of physical or geometrical interference.

FIG. 4A graphically illustrates first and second alignment features 1 and 2, respectively, showing the compatibility of engagement bosses 32 with alignment slots 30 and the compatibility of engagement boss 33 with alignment slot 31; while FIG. 4B shows the incompatibility (i.e., geometrical interference and thus inability to effectively mate/engage with each other) of engagement boss 33 and engagement bosses 32 with alignment slots 30 and 31, respectively, thus preventing inadvertent matching and mating of these features. Thus, the present system, injector and method ensures the correct alignment of the fuel injector on each engine platform 1 and 2 whereby fuel injector 12 is properly oriented in the correct rotative position required for each engine platform by only permitting the mating, keyed matching, and/or effective engagement of compatible alignment and engagement features.

By selectively locating engagement boss 32 and/or 33 circumferentially upon prong 24, or by selectively locating boss 32 and/or 33 upon prong 26, or by selectively locating boss 32 and/or 33 between the prongs, a selected orientation of fuel injector 12 of the present invention may be achieved to accommodate the given engine platform upon which the fuel injector is being applied.

Thus the same fuel injector 12 may be used on a variety of different engine platforms having different circumferentially oriented injector mounting positions, while ensuring the injector is properly mounted in the respective mounting position of each engine platform.

Figure 5:
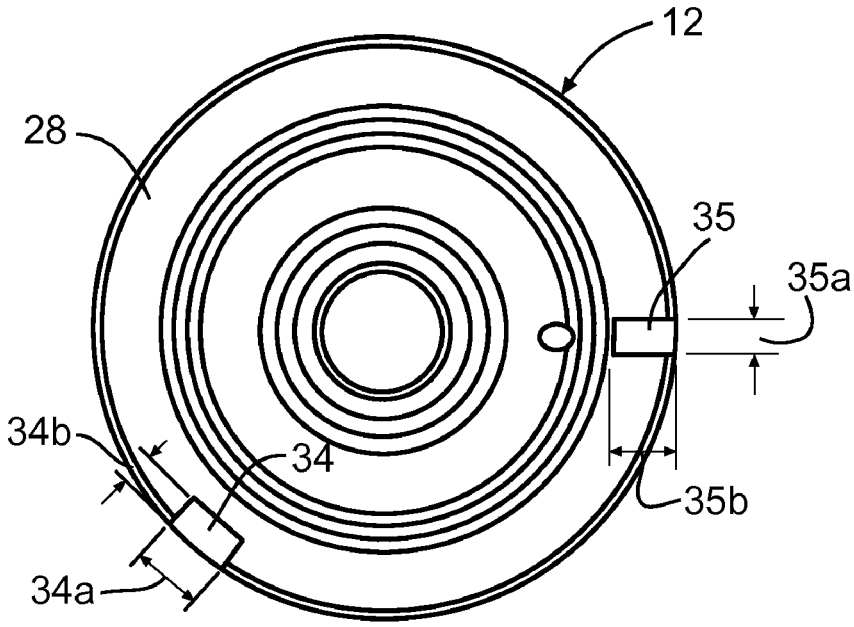
FIG. 5 a present top view similar to that of FIG. 3 illustrating an alternate embodiment of the present invention.
Figure 6:
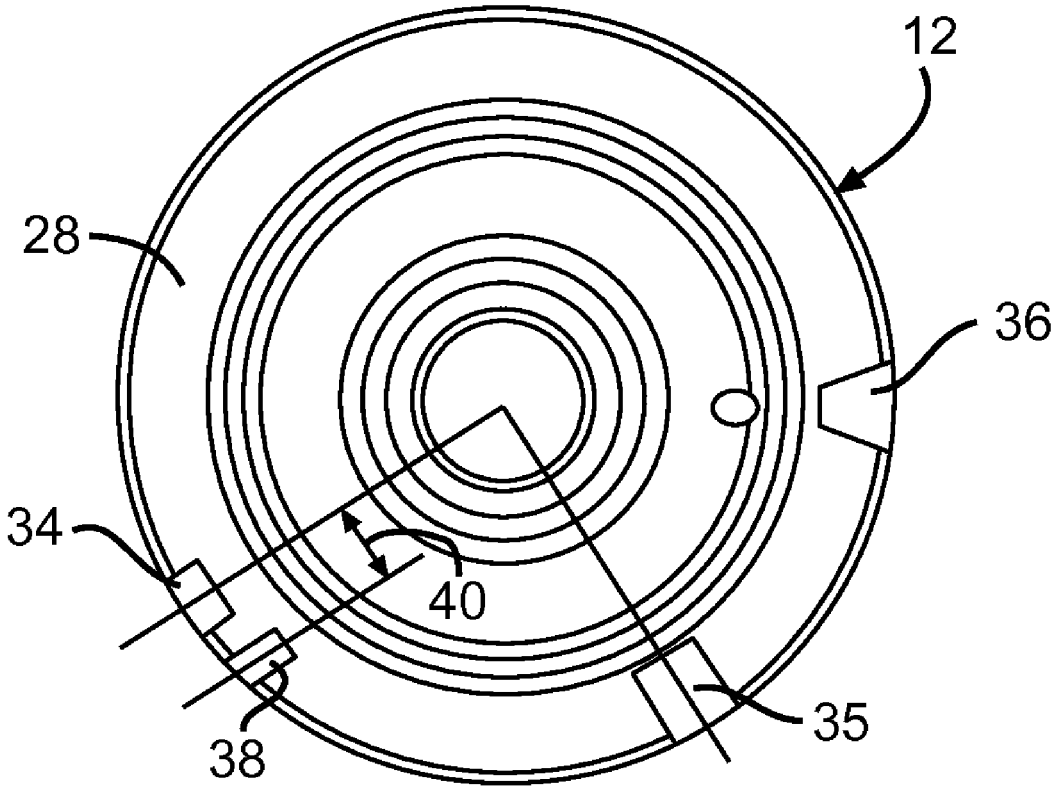

As illustrated in FIGS. 3, 5, and 6, various combinations of different injector alignment features, each corresponding to a compatible engagement feature of a particular engine platform, may be formed on a single injector to prevent mounting the injector in an incorrect misaligned circumferential position on a particular engine platform. Also, using two or more different alignment features on a single injector in accordance with the present invention permits a particular injector to be mounted on multiple engine platforms in correct rotative/circumferential alignment without requiring different injector models/part numbers for each engine platform.

For example, FIG. 5 illustrates a fuel injector having a pair of incompatible boss engaging notches. As illustrated in FIG. 5, fuel injector 12, in addition to having slot or notch 35, further includes slot or notch 34. Notch 35 has a depth 35*b* greater than its width 35*a*. While the depth 34*b*, of notch 34, is less than its width 34*a*. Therefore, an engagement boss corresponding to the configuration of alignment notch 35 will indexingly mate with alignment notch 35 but will not seat within notch 34 since the engagement boss will have a depth greater than the depth 34*b* of notch 34. An engagement boss configured to alignment notch 34, will indexingly mate with alignment notch 34 but will not seat within notch 35 since the engagement boss will have a width greater than the width 35*a* of notch 35. Thus a single fuel injector 12, having alignment notches 35 and 34, may be used with two engine platforms by appropriately geometrically configuring, i.e. dimensioning, sizing and/or shaping, the engagement boss, on prong 24 or 26, associated with each engine platform, for engagement with its associated alignment notch. That is, the engagement bosses are preferably dimensioned, sized, and shaped to correspond to the dimensions, size, and/or shape of a respective notch to enable the boss to mate with and engage the similar notch, while preventing engagement with other notches having a dissimilar dimension, size, and/or shape.

Various key type arrangements (alignment and engagement feature combinations) are possible to accommodate a wide range of engine platforms by one fuel injector type or part number. For example, as illustrated in FIG. 6, two additional notch/boss configurations 36 and 38 have been added whereby fuel injector 12 may accommodate four differing engine platforms. It should be noted that alignment notch 38 has not been placed upon a radial line from the center of the fuel injector but is offset a distance 40 from an otherwise radial line, and that notch 36 comprises converging side walls.

Again, care must be taken to assure that each of the engagement bosses for notches 30, 31, 34, 35, 36 and 38 is geometrically incompatible with all other notches. As noted above, this may be accomplished by geometric sizing of the boss-notch configurations such that structural geometrical/physical interference between the boss and notch prevents incorrect orientation of the fuel injector. Thus a single fuel injector, having alignment notches as illustrated in FIG. 6, may be used on, at least, four differing engine platforms by rotatively positioning the injector in the mounting bore such that alignment feature, i.e. notch or notches, corresponding to the particular engine platform of the engine, is aligned with the engagement feature, i.e. boss or bosses, on the clamp assembly of the engine.

Further a fifth engine platform may be additionally accommodated by employing two or more alignment notches with two respective compatible bosses thereby forming a key-type arrangement wherein the bosses on the clamp prongs simultaneously key-into their associated notches on the fuel injector.

Thus, as illustrated in FIGS. 3, 5, and 6, a given fuel injector type, having one part number, may include a prearranged multiplicity (two or more) of alignment features, i.e., slots or notches, thereby allowing the injector to be used on various engine platforms by providing the prongs of the fuel injector clamp assembly of each engine platform with a designated engagement feature, i.e., boss or bosses, for keyed/matched engagement with the corresponding alignment feature to ultimately ensure the injector is in the properly aligned rotative or circumferential position associated with each engine platform. Also, it should be noted that any two or more of the alignment and engagement feature combinations may be used beyond the combinations shown herein. Further, the two or more alignment/engagement feature combinations disclosed by this invention may include other sizes, shapes and/or dimensions beyond the specific examples provided herein as long as the features ensure secure positioning of the injector in a proper rotative position in an engine platform while also permitting secure positioning of the same injector in a different rotative position in a different engine platform. For example, the features may have rounded or curved portions. Further, the notches may be formed on the clamp while the bosses may be formed on the injector.

While the invention has been described by reference to various specific embodiments it should be understood that numerous changes may be made within the spirit and scope of the inventive concepts described, accordingly, it is intended that the invention not be limited to the described embodiments but will have full scope defined by the language of the following claims.

We claim:

1. In a fuel injected internal combustion engine, a method of mounting a fuel injector in a proper rotative orientation in an injector mounting bore of any one of multiple internal combustion engine platforms capable of receiving the fuel injector, the engine platforms requiring differing fuel injector orientations, the method comprising:

a) providing a fuel injector having a first alignment feature with a first geometry corresponding to a first engagement feature of a first engine platform and a second alignment feature having a second geometry different from said first geometry and corresponding to a second engagement feature of a second engine platform;

b) inserting said fuel injector into the mounting bore of the first engine platform;

c) providing a fuel injector hold down clamp attached to the internal combustion engine and including the first engagement feature, said first engagement feature being compatible with said first alignment feature for engaging said first alignment feature;

d) positioning the fuel injector with said first alignment feature in alignment with said first engagement feature and engaging said first alignment feature with said first engagement feature thereby rotatively orientating the fuel injector for said first engine platform.

2. The method of claim 1, wherein said first alignment feature is incompatible with the second engagement feature, and said second alignment feature is incompatible with said first engagement feature.

3. The method of claim 2, wherein said first alignment feature includes a pair of notches and said first engagement feature includes a pair of bosses adapted to engage said pair of notches.

4. The method of claim 3, wherein said second alignment feature includes is a single notch and said second engagement feature is a single boss.

5. The method of claim 2, wherein said first alignment feature includes a depth and said second alignment feature includes a depth greater than the depth of said first alignment feature.

6. The method of claim 5, wherein said first alignment feature includes a width greater than a width of said second alignment feature.

7. The method of claim 1, wherein said injector includes at least one alignment feature in addition to said first and said second alignment features.

8. A fuel injector mountable in a mounting bore of a first engine platform and a mounting bore of a second engine platform of fuel injected internal combustion engines, comprising:

a fuel injector body including a first alignment feature having a first geometry corresponding to a first engagement feature of the first engine platform and adapted to be engaged by the first engagement feature to secure the injector to the first engine platform, said fuel injector further including a second alignment feature having a second geometry different from said first geometry and corresponding to a second engagement feature of the second engine platform, said second alignment feature adapted to be engaged by the second engagement feature to secure the injector to the second engine platform.

9. The injector of claim 8, wherein said first alignment feature is incompatible with the second engagement feature, and said second alignment feature is incompatible with said first engagement feature.

10. The injector of claim 9, wherein said first alignment feature includes a pair of notches and said first engagement feature includes a pair of bosses adapted to engage said pair of notches.

11. The injector of claim 10, wherein said second alignment feature includes is a single notch and said second engagement feature is a single boss.

12. The injector of claim 9, wherein said first alignment feature includes a depth and said second alignment feature includes a depth greater than the depth of said first alignment feature.

13. The injector of claim 12, wherein said first alignment feature includes a width greater than a width of said second alignment feature.

14. The injector of claim 8, wherein said injector includes at least one alignment feature in addition to said first and said second alignment features.

15. In combination, a fuel injector mountable in a mounting bore of a first engine platform and a mounting bore of a second engine platform of fuel injected internal combustion engines, and a fuel injector hold down clamp, comprising:

a) the fuel injector hold down clamp adapted to secure the fuel injector in the mounting bore of a internal combustion engine, said clamp including a first engagement feature;

b) said fuel injector including a first alignment feature having a first geometry corresponding to the first engagement feature of the first engine platform and adapted to be engaged by said first engagement feature to secure the injector in the mounting bore of the first engine platform, said fuel injector further including a second alignment feature having a second geometry different from said first geometry and corresponding to a second engagement feature of the second engine platform, said second alignment feature adapted to be engaged by the second engagement feature to secure the injector on the second engine platform.

16. The injector and clamp combination of claim 15, wherein said first alignment feature is incompatible with the second engagement feature, and said second alignment feature is incompatible with said first engagement feature.

17. The injector and clamp combination of claim 16, wherein said first alignment feature includes a pair of notches and said first engagement feature includes a pair of bosses adapted to engage said pair of notches.

18. The injector and clamp combination of claim 17, wherein said second alignment feature includes is a single notch and said second engagement feature is a single boss.

19. The injector and clamp combination of claim 16, wherein said first alignment feature includes a depth and said second alignment feature includes a depth greater than the depth of said first alignment feature.

20. The injector and clamp combination of claim 16, wherein said first alignment feature includes a width greater than a width of said second alignment feature.

21. The injector and clamp combination of claim 16, wherein said injector includes at least one alignment feature in addition to said first and said second alignment features.

22. A fuel injector hold down clamp for use on a fuel injected internal combustion engine comprising:

a) a main body, b) means for attaching said main body to the engine, c) a lever arm extending outward from said main body, said lever arm including at least one prong for straddling a fuel injector, d) at least two convex bosses extending from said at least one prong to engage two associated concave notches upon a fuel injector.

* * * * *